US007669279B2

(12) United States Patent
Crevling, Jr. et al.

(10) Patent No.: US 7,669,279 B2
(45) Date of Patent: Mar. 2, 2010

(54) LIQUID-DISPENSING ATTACHMENT FOR VACUUM CLEANERS

(75) Inventors: Robert L. Crevling, Jr., Williamsport, PA (US); Kevin D. Fry, South Williamsport, PA (US)

(73) Assignee: Shop-Vac Corporation, Williamsport, PA (US)

( * ) Notice: Subject to any disclaimer, the term of this patent is extended or adjusted under 35 U.S.C. 154(b) by 1215 days.

(21) Appl. No.: 11/213,388

(22) Filed: Aug. 25, 2005

(65) Prior Publication Data

US 2007/0044265 A1 Mar. 1, 2007

(51) Int. Cl.
*A47L 7/00* (2006.01)

(52) U.S. Cl. ..... 15/320; 15/246.2

(58) Field of Classification Search ..... 15/320–322, 15/344, 246.2; *A47I 7/00, 9/00*
See application file for complete search history.

(56) References Cited

U.S. PATENT DOCUMENTS

| | | | | |
|---|---|---|---|---|
| 2,996,134 | A | 8/1961 | Muerle et al. | |
| 3,958,298 | A | 5/1976 | Cannan | |
| 4,156,952 | A * | 6/1979 | Lynch, Jr. | 15/320 |
| 4,559,667 | A | 12/1985 | Fitzwater | |
| 4,845,802 | A | 7/1989 | Miller et al. | |
| 4,984,328 | A | 1/1991 | Berfield | |
| D316,317 | S | 4/1991 | Berfield | |
| 5,103,526 | A | 4/1992 | Berfield | |
| 5,555,597 | A | 9/1996 | Berfield | |
| 5,603,139 | A | 2/1997 | Alazet | |
| 5,697,120 | A | 12/1997 | Robinson | |
| 6,073,300 | A | 6/2000 | Zahuranec et al. | |
| 6,536,071 | B2 | 3/2003 | Zahuranec et al. | |
| 2002/0162187 | A1 | 11/2002 | Keller | |
| 2003/0070248 | A1 | 4/2003 | Jonsson | |
| 2007/0020040 | A1 | 1/2007 | Sacks | |

FOREIGN PATENT DOCUMENTS

| | | |
|---|---|---|
| DE | 638 220 | 11/1936 |
| DE | 299 03 868 | 5/2000 |
| DE | 20 2004 019888 | 2/2004 |
| GB | 2 409 966 | 7/2005 |
| WO | WO-00/78198 | 12/2000 |

OTHER PUBLICATIONS

International Preliminary Report on Patentability for International Application No. PCT/US2006/033293, dated Feb. 26, 2008.
International Search Report for International Application No. PC/US2006/033293, dated Apr. 12, 2007.
Written Opinion for International Application No. PCT/US2006/033293, dated Apr. 12, 2007.

* cited by examiner

*Primary Examiner*—David A Redding
(74) *Attorney, Agent, or Firm*—Marshall, Gerstein & Borun LLP

(57) ABSTRACT

A wall-mountable mounting bracket and fluid-dispensing attachment for a vacuum cleaner. The attachment can be used to dispense cleaning fluid to an area to be cleaned. The fluid is sucked up along with dirt by the vacuum. A remotely-activatable valve allows user's to selectively shut off the flow of fluid. Retractable wheels can be moved between a usage position and a storage position. In the storage position, the axis of the wheels is above the lowermost side of the attachment and any overhang of the lowermost edge of the wheels is less than the thickness of a corresponding part of the mounting bracket.

11 Claims, 9 Drawing Sheets

LIQUID-DISPENSING ATTACHMENT FOR VACUUM CLEANERS

BACKGROUND OF THE INVENTION

This invention relates generally to cleaning systems, and more particularly to attachments for vacuum cleaners that can be used for spot cleaning.

Prior art cleaning systems include vacuums, wet/dry vacuums, and extractors. While traditional vacuums are generally used only to remove dry materials, wet/dry vacuums can be used to pick up liquids or wet materials. Other cleaners apply a cleaning fluid, such as a solution of water and detergent, to the surface to be cleaned. The fluid can facilitate cleaning by dissolving and lifting dirt from the surface. Subsequent suctioning lifts away the dirt and the fluid and also helps to dry the surface.

Cleaning fluids can be used in different types of products. Many extractors include a cleaning fluid spray system contained as a unit along with a wet/dry vacuum. Fluid dispensing systems can also be arranged as attachments for conventional vacuums or wet/dry vacuums. U.S. Pat. No. 5,103,526, for example, discloses a fluid-dispensing unit that can be attached to a wet/dry vacuum and used to apply a cleaning fluid for spot-cleaning.

Portability, maneuverability, and storage of such attachments are a concern. Wheels are sometimes used to improve the maneuverability of the nozzle of a cleaner, but wheels increase the size of the unit, and can make it unwieldy to store. Retractable wheels are illustrated, for example, in U.S. Pat. No. 4,845,802, but the product is still bulky.

BRIEF SUMMARY OF THE INVENTION

The applicants have developed a spot-cleaning attachment for vacuum cleaners that is easy to maneuver but compactable enough for hanging on a wall.

BRIEF DESCRIPTION OF THE DRAWINGS

The invention may be better understood by referring to the accompanying drawings, in which:

FIG. 1 shows the attachment in the usage position, and FIG. 2 shows the attachment with the tank partially removed.

FIG. 3 corresponds with FIG. 1, and FIG. 5 corresponds with FIG. 2.

DETAILED DESCRIPTION OF A PREFERRED EMBODIMENT

Figure 1:
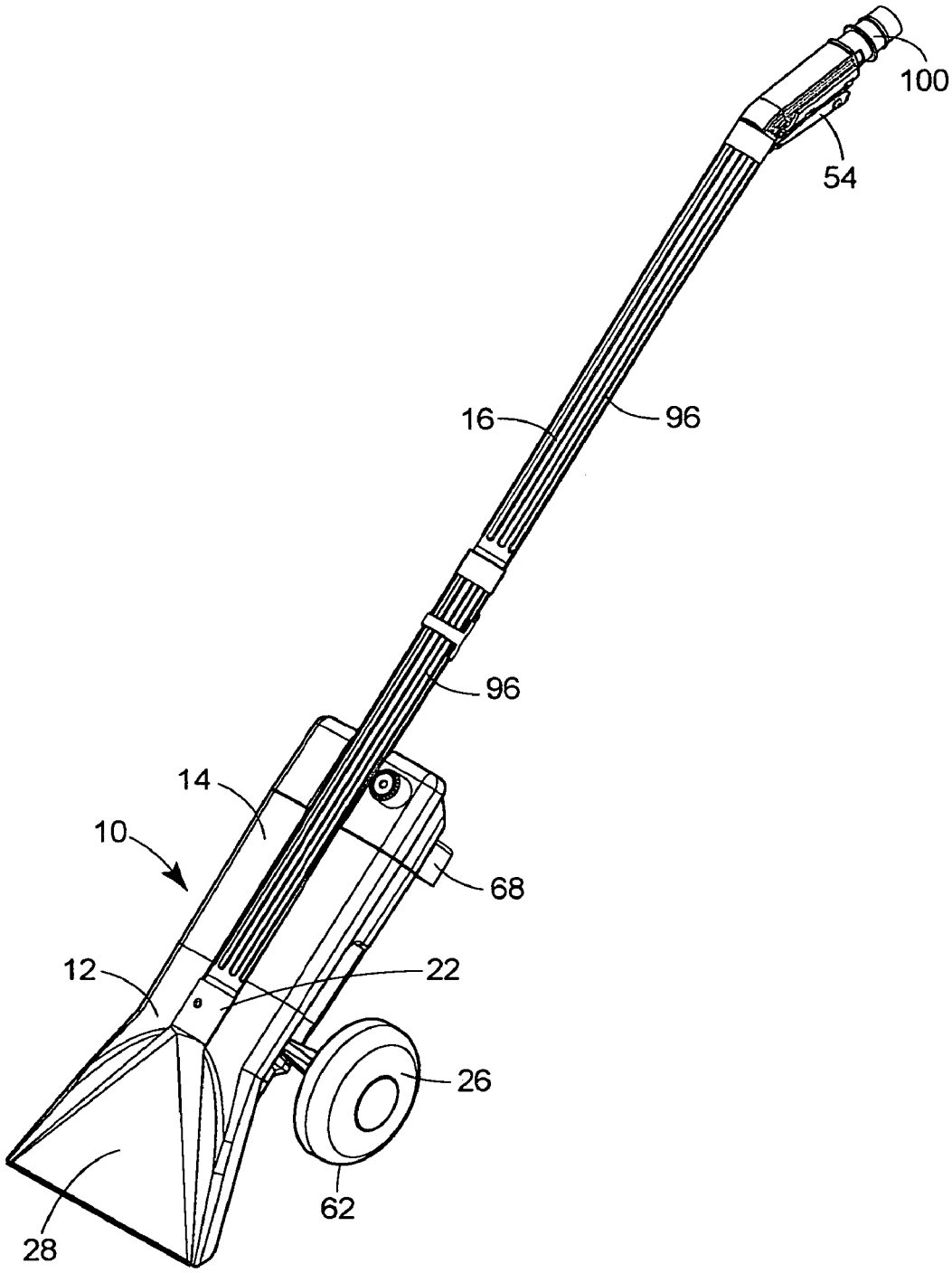
FIGS. 1 and 2 are perspective views of one embodiment of an attachment that uses the invention.
Figure 2:
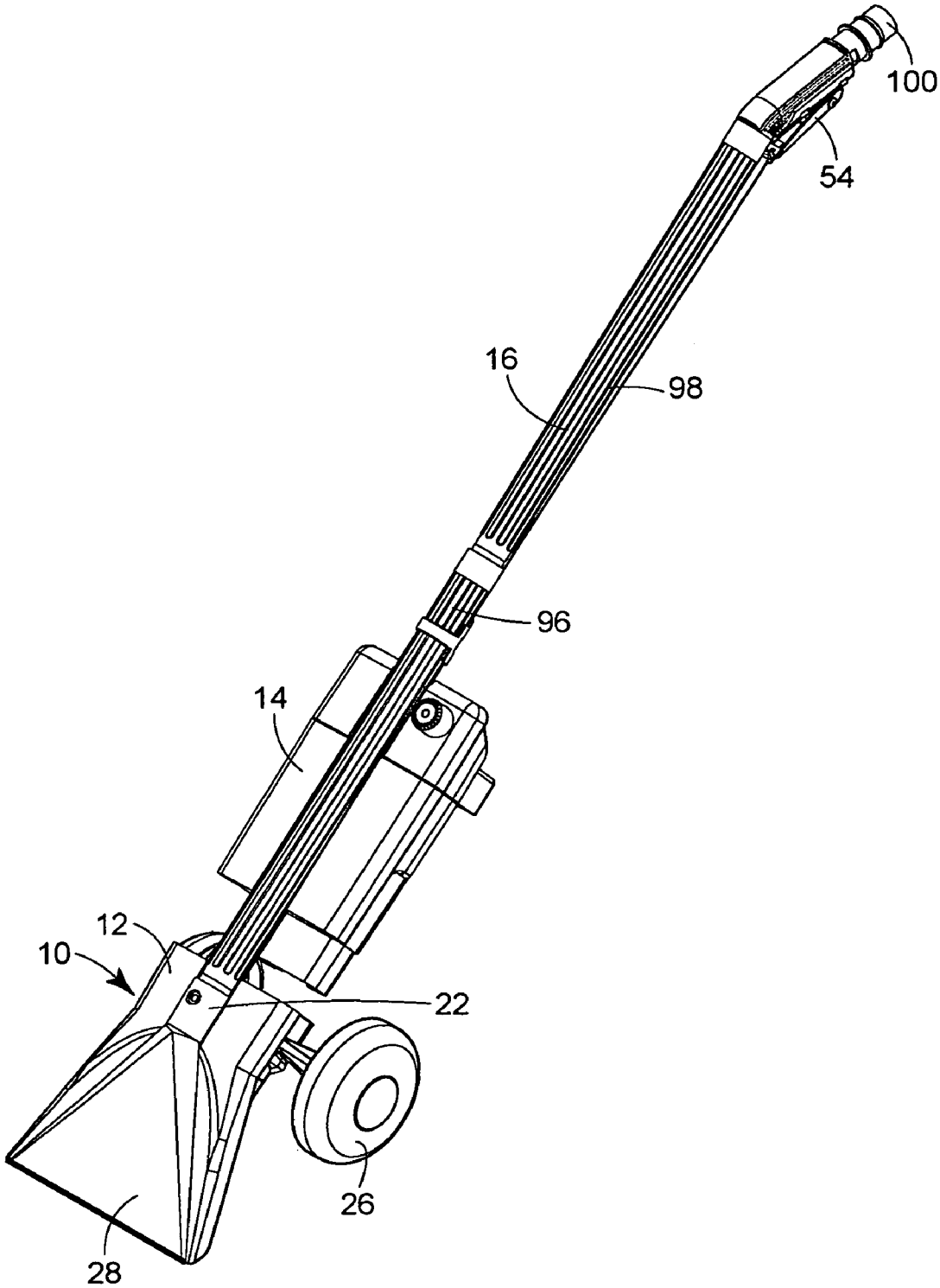
Figure 3:
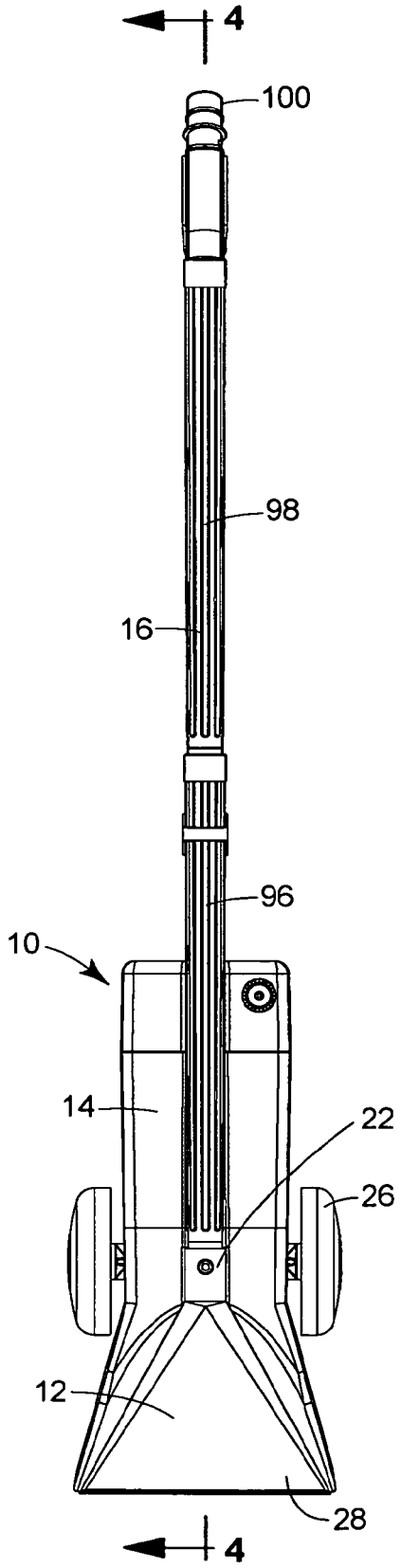
FIGS. 3 and 5 are plan views from the top of the attachment.

The figures illustrate one embodiment of an attachment for a vacuum cleaner that uses the present invention. As seen in FIGS. 1-6, the spot-cleaning attachment 10 includes a base 12, wheels 26, a tank 14, a wand 16, and a mounting bracket 18.

The Base

The base 12 includes an outlet fitting 22 (seen in FIGS. 1-3), a dispensing system (described below), and retractable wheels 26. In general, the configuration of the base 12 can vary. The illustrated base can be molded from plastic. Near the outlet fitting 22 and the wheels 26, the illustrated base is generally rectangular in cross section, with a width of about 6 inches and a height of about 4 inches. The opposite end of the base tapers into the form of a nozzle 28 that is about 9½ inches wide and about 2 inches high. When in use, dirt and fluid from the spot to be cleaned is drawn through the nozzle to an outside suction source, as explained below.

The configuration of the outlet fitting 22 can vary. Functionally, the outlet fitting provides a fluid connection between the nozzle 28 and the wand 16. Many suitable arrangements are known in the art and can be used.

Figure 6:
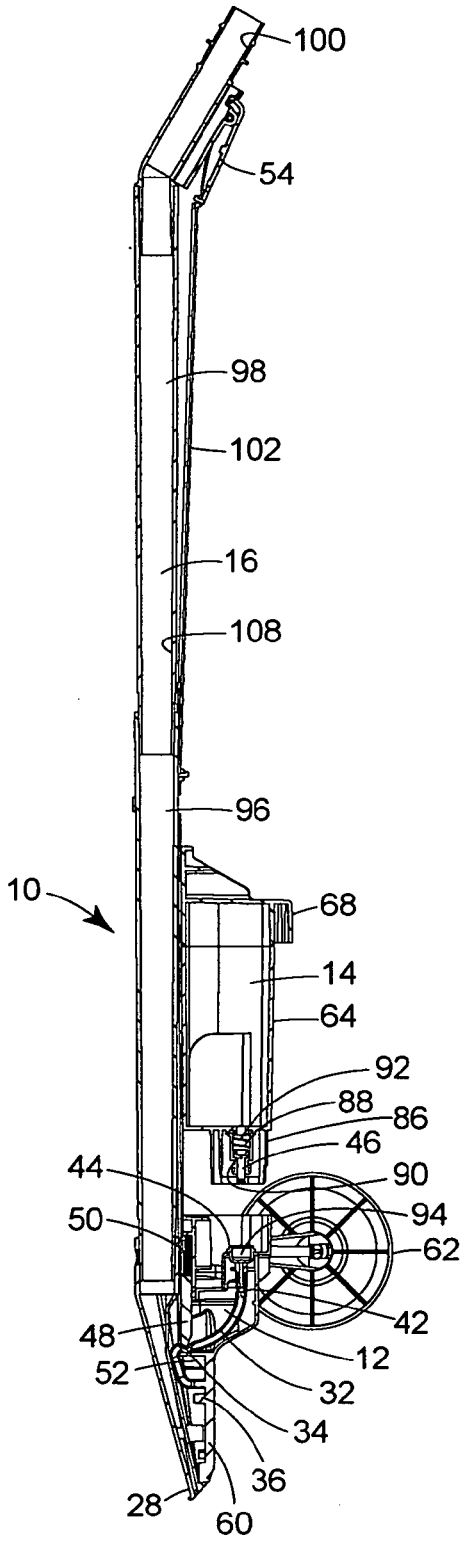
Figure 7:
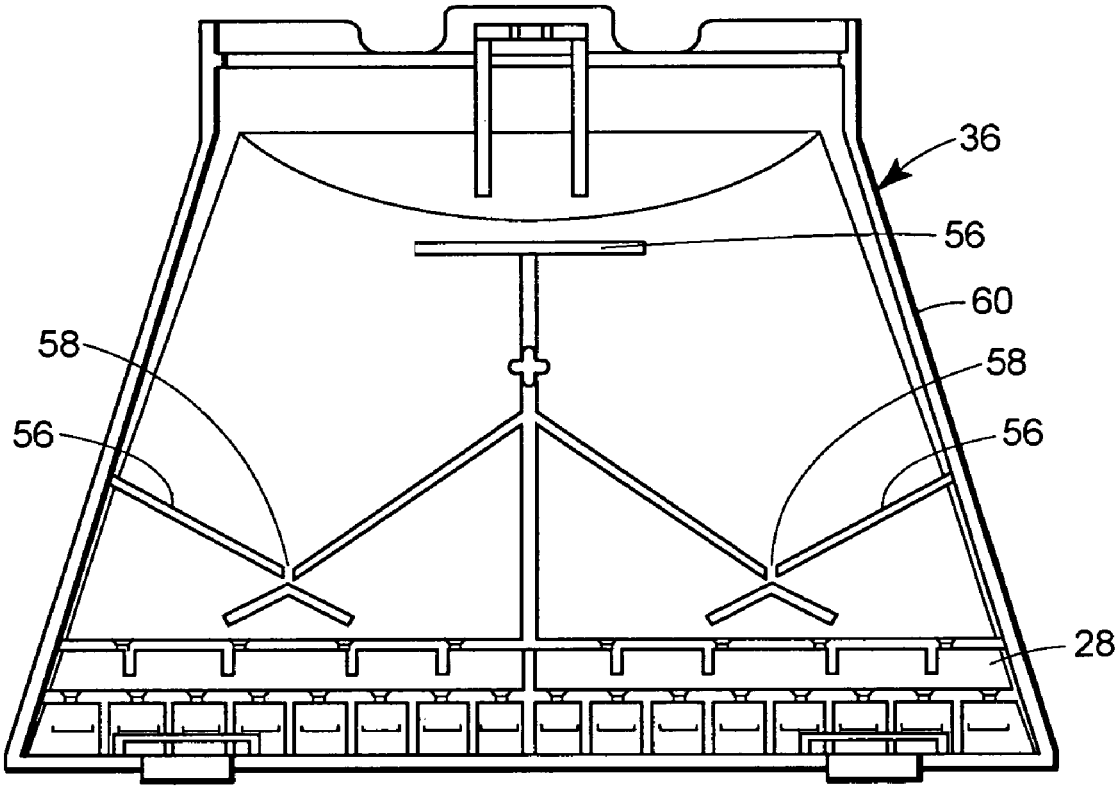
FIG. 7 is an enlarged view inside the base of the attachment.

The dispensing system delivers cleaning fluid from the tank 12 to the floor near the nozzle 28. A variety of different types of dispensing systems can be used. The dispensing system illustrated in FIGS. 4, 6, and 7 includes a hose 32, a valve 34, and a flow divider 36 (FIG. 7).

The illustrated hose 32 is made of flexible plastic and extends from an inlet fitting 42 adjacent the tank 14 to the flow divider 36 at the other end of the base 12. Although other inlet fittings can be used, the illustrated inlet fitting includes a collar 44. As described in more detail below, this inlet fitting interacts with a plunger 46 on the illustrated tank 14. The hose 32 could also be made of rigid piping, instead of flexible plastic. When the attachment 10 is in use, the illustrated inlet fitting 42 is disposed above the flow divider 36 so that gravity urges the cleaning fluid to flow from the tank through the hose to the flow divider.

Figure 4:
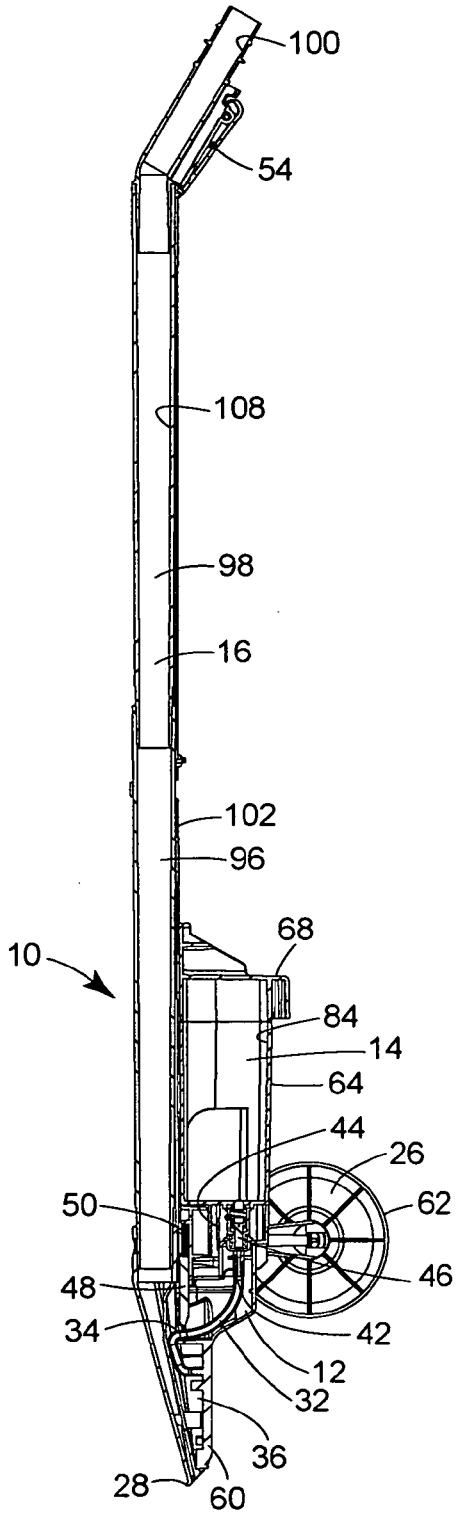
FIGS. 4 and 6 are sectional views through lines 4-4 and 6-6 of FIGS. 3 and 4, respectively.
Figure 5:
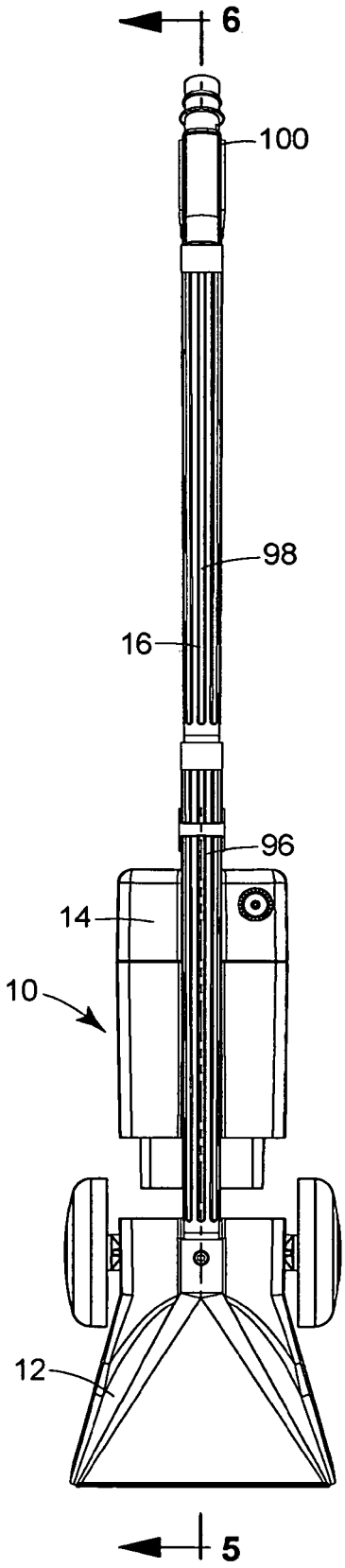

The valve 34 controls flow through the hose 32. The illustrated valve 34 includes a blade 48 that is mounted for vertical movement within the housing 12 and is biased by a spring 50 into a lower position (seen in FIG. 6). In that lower position, the blade pinches the hose against a plate 52, shutting off potential flow of fluid through the hose. As discussed below, a trigger 54 on the wand 16 enables a user to selectively raise the blade (as seen in FIG. 4), opening the hose and allowing fluid from the tank 14 to drain to the flow divider 36. Other types of valves can also be used.

The flow divider 36 (best seen in FIG. 7) distributes the flow of cleaning fluid across the width of the nozzle 28. Although any of a variety of other possible flow dividers might be used (including conventional spray nozzles), the illustrated flow divider includes shelves 56 with spaced openings 58 mounted on a rear cover 60 on the base 12. The shelves and openings are arranged to progressively divide the flow of cleaning fluid from the hose 32 and distribute it relatively evenly across the width of the nozzle.

The Wheels

Figure 9:
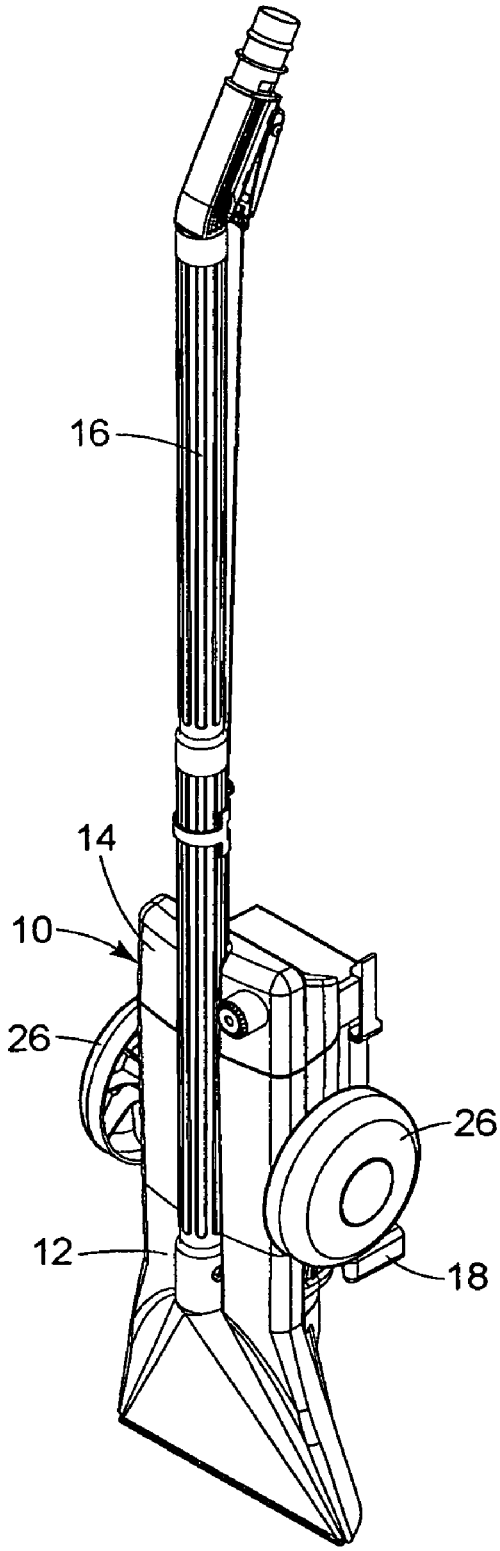
FIG. 9 is a perspective view of the attachment on an associated mounting bracket.
Figure 10:
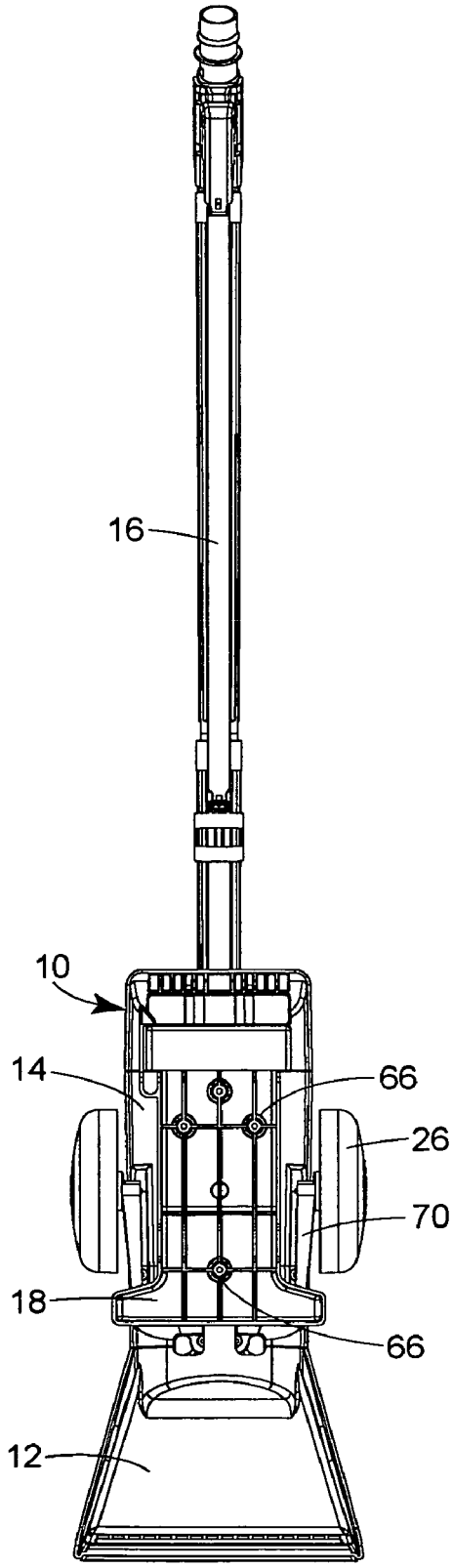
FIG. 10 is a back view of the attachment and mounting bracket seen in FIG. 9.
Figure 11:
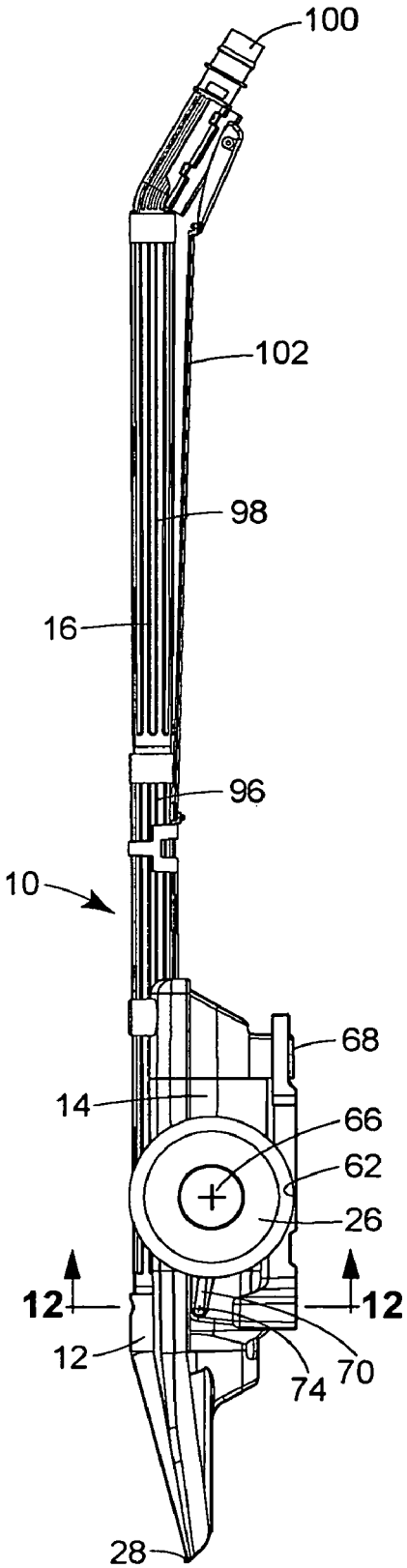
FIG. 11 is a side view of the attachment and the mounting bracket seen in FIG. 9.
Figure 12:
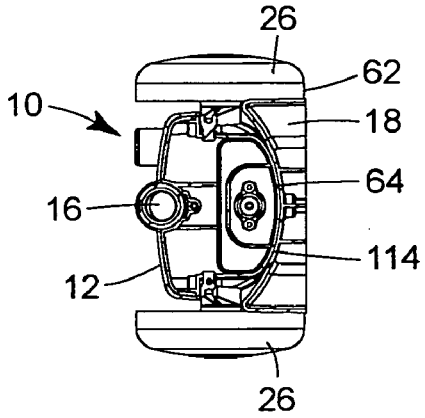
FIG. 12 is a sectional view through lines 12-12 of FIG. 11.

The retractable wheels 26 can be moved from a usage position (seen in FIG. 1) to a storage position (seen in FIG. 9). In the usage position, the lowermost edge 62 of the illustrated wheels 26 (best seen in FIG. 6) is spaced more than about 4½ inches from the ventral (lowermost or rearward most) side 64 of the base 12 and the tank 14. This arrangement enables the attachment 10 to be supported by the wheels with the nozzle 28 on the floor and the base inclined at an angle of approximately 45 degrees to the horizontal. In the storage position, the axis 66 of the wheels 26 is dorsal to (above) the ventral side 64 of the base and the tank (see FIG. 11), and the lowermost edge of the wheels is spaced no more than about 1" ventral to (below) the ventral side. This arrangement enables the attachment to be hung from the relatively-thin mounting bracket 18, as seen in FIGS. 9-12 and described more fully below.

Figure 8:
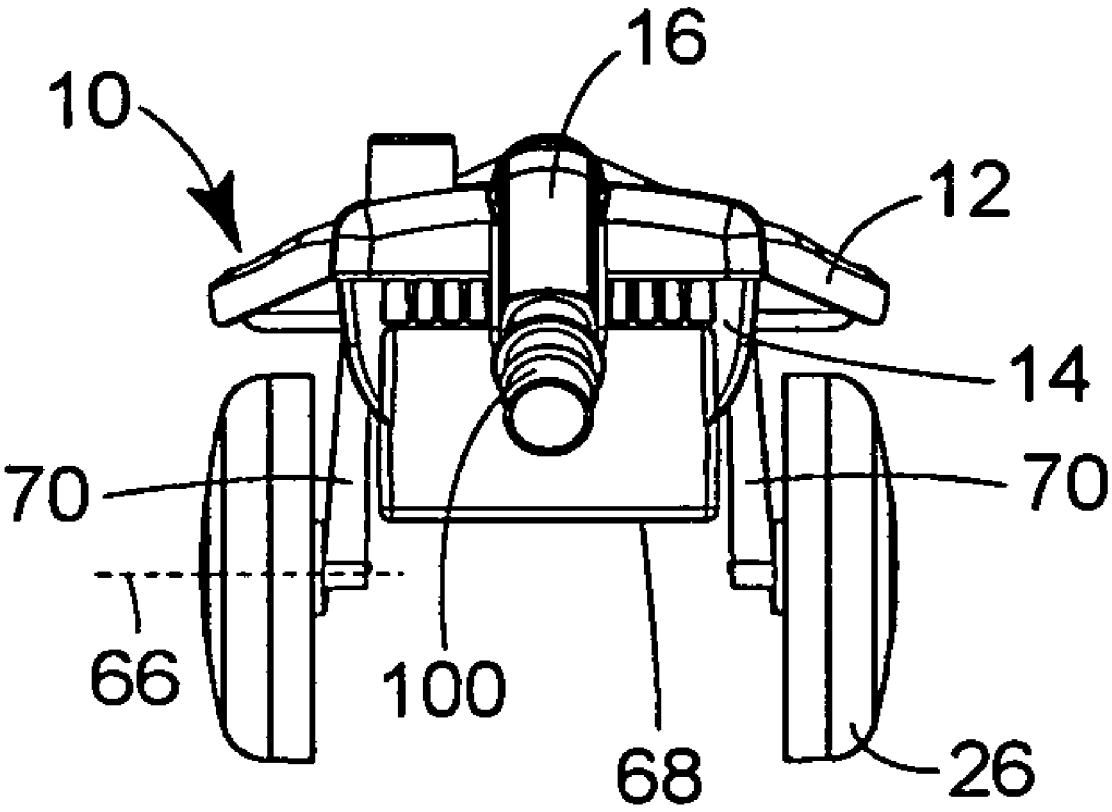
FIG. 8 is an end view from the top of the attachment.
Figure 13:
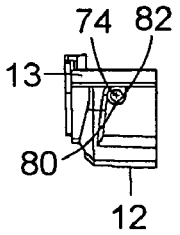
FIG. 13 is a fragmentary view of keyways on the base of the attachment.
Figure 14:
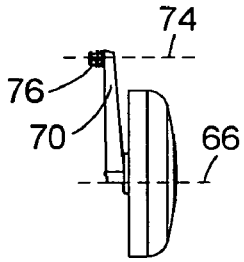
FIG. 14 is a side view of one of the wheels of the attachment.

In the illustrated embodiment of the invention, the wheels 26 are designed to be rotated from the usage position to the storage position. To enable such rotation, each illustrated wheel is mounted on an arm 70 (best seen in FIG. 8) that separates the wheel's axis 66 from a mounting axis 74 (see FIG. 14). The illustrated arms 70 are about 4¾ inches long, and each arm has a planar key 76 at the mounting axis 74. Each key fits into one of two keyways 80, 82 that form part of an aperture in the base 12 (FIG. 13). The keyways each extend radially from the mounting axis 74. In the illustrated attachment 10, the keyways 80, 82 are located about 7 inches behind the tip of the nozzle 28 (see FIG. 11), and about 3 inches above the lowermost side 64 of the attachment. One keyway 80 holds the associated key in a position that keeps the wheel in the usage position, and the other keyway 82 holds the key in a position that keeps the wheel in the storage position. Each illustrated wheel can be pushed to disengage the key from a keyway before rotating the arm to the other position. Other arrangements could also be used for holding the wheels in their positions.

The illustrated wheels 26 are about 5½ inches in diameter, and the illustrated arms 70 can be rotated through an angle of about 85 degrees from the storage position to the usage position. Although other dimensions and configurations can be used, the illustrated arrangement results in the lowermost edge 62 of the wheels moving approximately 4½ inches with respect to the ventral side 64 of the attachment 10 when the wheels are moved from one position to the other. In the storage position illustrated in FIG. 11, the lowermost edge 62 of the wheels is roughly even with the ventral side 64 of the attachment. Alternatively, the lowermost edge of the wheels could be above the ventral side of the attachment, or, as described below, could be a short distance below the ventral side of the attachment, forming an overhang.

In the illustrated attachment, each arm 70 extends at almost a right angle to the axis 66 of its associated wheel 26, and the mounting axes 74 are parallel to the wheels' axes. The use of parallel axes causes the wheels to remain on a constant plane as they are rotated from one position to the other. This is not always necessary, however, and other arrangements can also be used.

The Tank

The tank 14 includes a reservoir 84 for cleaning fluid (see FIG. 4). The illustrated reservoir has a volume of approximately ½ gallon, although other sizes could also be used. Although not necessary, the illustrated tank is removable. As seen in FIG. 6, the plunger 46 in the tank 14 is mounted for vertical movement within a sleeve 86 on the bottom of the tank The upper end of the plunger has a seal 88 that seats against a lip 90 at the bottom of the reservoir. A spring 92 biases the plunger downwardly, pressing the seal 88 against the lip 90, and holding cleaning fluid in the reservoir. For use, the tank 14 is mounted on the base 12 with the sleeve 86 on the tank fitting within the collar 44 on the base. As the tank is lowered into position on the base, the lower end of the plunger 46 stops against a rim 94 in the collar, causing the plunger to move upwardly with respect to the tank. This relative motion lifts the seal 88 from the lip 90, permitting the fluid in the reservoir to flow into the hose 32. When desired, a variety of other arrangements could also be used for mounting a removable tank.

The Wand

The wand defines a nominal length dimension of the attachment, and fluidly connects the base 12 of the attachment 10 to a vacuum source. Although other arrangements could be used, the illustrated wand 16 (best seen in FIGS. 1-6) can also serve as a handle, and includes a lower section 96, an upper section 98, and a connector 100 that enables one end of an interior channel 108 in the wand (FIGS. 4 and 6) to be fluidly connected to an outside suction source, such as a vacuum or a suction cleaner. The lower section 96 of the wand can be retained in the outlet fitting 22 on the base 12 by any convenient means, such as by a spring-biased button detent. The connection of the wand to the base places the nozzle 28 in fluid communication with the suction source, allowing dirt and liquid to be drawn from the floor to the suction source.

The trigger 54 on the illustrated wand 16 is connected by a mechanical linkage 102 (best seen in FIG. 6) to the valve 34 in the base 12. Through the linkage, squeezing the trigger 54 raises the blade 48, allowing cleaning fluid to flow through the hose 32 to the floor. When the trigger is released, the spring 50 presses the blade into the hose, pinching off the flow of fluid.

The Mounting Bracket

Although the arrangement of the mounting bracket can vary, the illustrated mounting bracket 18 (best seen in FIGS. 9-11) is about 7 inches wide, 10 inches high, and 1 inch thick. In the illustrated product, the mounting bracket is narrow enough that it fits between the wheels 26 of the attachment 10. Optional screw holes 66 (FIG. 10) permit the mounting bracket to be easily screwed or nailed to a wall. A mount 68 on the attachment (see FIG. 6) is arranged to selectively hold the attachment to the mounting bracket. Any conventional arrangement for the mount and mounting bracket can be used. When the attachment 10 is mounted with the illustrated bracket 18, the lowermost side 64 of the base 12 and the tank 14 fits into a depressed area 114 of the mounting bracket (see FIG. 12). The thinnest part of this depressed area fits against the lowermost side of the attachment. Because of the special arrangement of the retractable wheels 26, when the illustrated attachment 10 is hung from a wall using the illustrated mounting bracket 18, any overhang of the wheels 26 beyond the ventral side 64 of the base 12 is less than the thickness of this corresponding part of the mounting bracket 18. Consequently, the wheels 26 do not touch the wall and the attachment only projects about 5 inches from the wall.

Although the illustrated mount 68 is on the tank 14, other forms of a mount could also be arranged on the base 12 or on the wand 16.

Because the illustrated attachment is entirely mechanical, it is relatively easy and inexpensive to manufacture, and is not itself subject to risks of electrical malfunction.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A fluid-dispensing attachment for a vacuum cleaner that has a width dimension and comprises:

a base component;

a connector that enables the attachment to be fluidly connected to a suction source;

a nozzle that is on the base component and is in fluid communication with the connector;

a cleaning fluid reservoir that is in the base component;

remotely-activatable valve that is arranged to selectively shut off potential flow from the reservoir;

a wand that extends from near the cleaning fluid reservoir, defining a nominal length dimension of the attachment that is perpendicular to the width dimension;

a ventral side of the cleaning fluid reservoir that is offset further than any other part of the reservoir in a ventral direction that is perpendicular to both the width dimension and the nominal length dimension of the attachment;

a wheel component that is hinged to the base component at a hinge position that is dorsal to the ventral side of the reservoir;

a wheel axle that is on the wheel component, extends in the width dimension of the attachment, and moves between a usage position and a storage position; and a wheel that is mounted on the wheel axle and—when the wheel axle is in the storage position—has an outer edge that extends no more than about 1" ventrally from the base component, and—when the wheel axle is in the usage position—helps support the attachment in a position with the nozzle on the floor and the attachment inclined at an angle of approximately 45 degrees to the horizontal.

2. The attachment of claim 1, in which the attachment has no electric motor.

3. The attachment of claim 1, in which:

the wheel is mounted on an arm that includes a key on the axle; and the attachment includes two keyways, one keyway corresponding with the storage position and the other keyway corresponding with the usage position.

4. A fluid-dispensing attachment as recited in claim 1, in which the reservoir is in a removable tank.

5. A fluid-dispensing attachment for a vacuum cleaner that has a width dimension and comprises:

a base component;

a connector that enables the attachment to be fluidly connected to a suction source;

a nozzle that is on the base component and is in fluid communication with the connector;

a cleaning fluid reservoir that is in the base component;

remotely-activatable valve that is arranged to selectively shut off potential flow from the reservoir;

a wand that extends from base component near the cleaning fluid reservoir, defining a nominal length dimension of the attachment that is perpendicular to the width dimension;

a ventral side of the cleaning fluid reservoir that is offset further than any other part of the reservoir in a ventral direction that is perpendicular to both the width dimension and the nominal length dimension of the attachment;

a wheel component that is hinged to the base component;

a wheel axle that is on the wheel component, extends in the width dimension of the attachment, and moves between (i) a storage position that is dorsal to the ventral side of the reservoir, and (ii) a usage position that is ventral to the ventral side of the reservoir; and a wheel that is mounted on the wheel axle.

6. A fluid-dispensing attachment as recited in claim 1, that also has:

a wall mountable mounting bracket; and a mount on the base component that is arranged to selectively hold the base component and the wheel component to the mounting bracket.

7. A fluid-dispensing attachment as recited in claim 6, in which the reservoir is in a removable tank.

8. A fluid-dispensing attachment as recited in claim 5, that also has:

a wall mountable mounting bracket; and a mount on the base component that is arranged to selectively hold the base component and the wheel component to the mounting bracket.

9. The attachment of claim 8, in which the attachment has no electric motor.

10. The attachment of claim 8, in which:

the wheel is mounted on an arm that includes a key on the axle; and the attachment includes two keyways, one keyway corresponding with the storage position and the other keyway corresponding with the usage position.

11. A fluid-dispensing attachment for a vacuum cleaner that has a width dimension and comprises:

a base component;

a connector that enables the attachment to be fluidly connected to a suction source;

a nozzle that is on the base component and is in fluid communication with the connector;

a cleaning fluid reservoir that is in the base component;

remotely-activatable valve that is arranged to selectively shut off potential flow from the reservoir;

a wand that extends from the base component near the cleaning fluid reservoir, defining a nominal length dimension of the attachment that is perpendicular to the width dimension;

a ventral side of the cleaning fluid reservoir that is offset further than any other part of the reservoir in a ventral direction that is perpendicular to both the width dimension and the nominal length dimension of the attachment;

a wheel component that is hinged to the base component at a hinge position that is dorsal to the ventral side of the reservoir;

a wheel axle that is on the wheel component, extends in the width dimension of the attachment, and moves laterally between (i) a storage position that is dorsal to the ventral side of the reservoir, and (ii) a usage position that is ventral to the ventral side of the reservoir; and a wheel that is mounted on the wheel axle and—when the wheel axle is in the storage position—has an outer edge that extends no more than about 1" ventrally from the base component, and—when the wheel axle is in the usage position —supports the attachment in a position with the nozzle on the floor and the attachment inclined at an angle of approximately 45 degrees to the horizontal.

* * * * *